US006378266B1

(12) United States Patent
Ellingson

(10) Patent No.: US 6,378,266 B1
(45) **Date of Patent: *Apr. 30, 2002**

(54) DOORJAMB ASSEMBLY WITH EXTRUDED PLASTIC COMPONENTS

(76) Inventor: Robert T. Ellingson, P.O. Box 2299, Covington, GA (US) 30209

( * ) Notice: Subject to any disclaimer, the term of this patent is extended or adjusted under 35 U.S.C. 154(b) by 0 days.

This patent is subject to a terminal disclaimer.

(21) Appl. No.: 09/270,342

(22) Filed: Mar. 16, 1999

Related U.S. Application Data

(63) Continuation-in-part of application No. 09/046,961, filed on Mar. 24, 1998, now Pat. No. 6,148,582, which is a continuation-in-part of application No. 08/865,373, filed on May 29, 1997, now Pat. No. 5,901,510, which is a continuation-in-part of application No. 08/549,056, filed on Oct. 27, 1995, now Pat. No. 5,634,303.

(51) Int. Cl.[7] ..... E04C 2/38

(52) U.S. Cl. ..... 52/656.4; 52/204.53; 52/204.7; 52/210; 49/504; 49/505; 49/DIG. 2

(58) Field of Search ..... 52/204.51, 204.53, 52/204.1, 212; 49/504, 505, DIG. 2, 656.4, 204.7, 210, 211, 212, 204.66

(56) References Cited

U.S. PATENT DOCUMENTS 4,550,540 A * 11/1985 Thorn ..... 52/309.4
4,793,109 A * 12/1988 Noach ..... 52/211
4,850,168 A * 7/1989 Thorn ..... 52/207
5,182,880 A * 2/1993 Berge, Jr. et al. ..... 49/504
5,412,909 A * 5/1995 Wu ..... 49/505
5,634,303 A * 6/1997 Ellingson ..... 52/210
5,758,458 A * 6/1998 Ridge ..... 52/204.1
5,836,118 A * 11/1998 Thornton et al. ..... 52/204.1
5,901,510 A * 5/1999 Ellingson ..... 52/210

FOREIGN PATENT DOCUMENTS

GB 2082234 * 3/1982

* cited by examiner

*Primary Examiner*—Carl D. Friedman
*Assistant Examiner*—Yvonne M. Horton
(74) *Attorney, Agent, or Firm*—Womble Carlyle Sandridge & Rice

(57) ABSTRACT

An improved doorjamb and brickmold is provided wherein an extruded thermoplastic molding and stop member is secured to wooden support members to define the doorjambs and mullions of a door and jamb assembly. The co-extruded plastic molding and stop members define both the stops of the assembly and the exposed decorative molding portion and also protect the wooden support members from exposure to the elements. A separate extruded extension adapts the structure for use with the wider opening in a modern thicker wall.

19 Claims, 9 Drawing Sheets

DOORJAMB ASSEMBLY WITH EXTRUDED PLASTIC COMPONENTS

REFERENCE TO RELATED APPLICATION

This Application is a continuation-in-part of U.S. patent application Ser. No. 09/046,961 filed Mar. 24, 1998 now U.S. Pat. No. 6,148,582, which is a continuation-in-part of U.S. patent application Ser. No. 08/865,373 filed May 29, 1997 now U.S. Pat. No. 5,901,510, which, in turn, is a continuation-in-part of patent application Ser. No. 08/549,056 filed Oct. 27, 1995, now U.S. Pat. No. 5,634,303.

FIELD OF THE INVENTION

This invention relates generally to door and window casings for framing openings in the walls of buildings to receive doors and windows. More specifically, the invention relates to an improved jamb assembly for such casings wherein elements of the jamb assembly, including the stop, brickmold, width extensions where applicable, and bottom portions of the side jamb members are formed from substantially solid extruded thermoplastic material.

BACKGROUND OF THE INVENTION

In constructing a building such as a house, it is common that openings for receiving doors are first roughly framed in with wall studs, which usually are made of wood. Subsequently, the rough framed openings are finished with a wooden door casing, which often is provided with a decorative exterior brickmold that abuts the brick or siding on the outside of the building. The door casing is formed from a pair of spaced vertical side jambs connected at their upper ends with a horizontal head jamb. A sill usually extends between the lower ends of the side jambs. In some instances, the brickmold of the casing is milled as an integral part of the jambs and in other instances the brickmold is nailed or stapled to the jambs along their outside edges. A stop usually is milled into the jambs and the stop extends around the inside peripheral face of the casing. In use, a closed door mounted in the casing rests against the stop. In many instances, the stop bears a weather strip that seals against the closed door to prevent drafts.

In sidelight door casings, a pair of spaced vertical mullions or mull posts extend between the sill and the head jamb to form a central opening for receiving a hinged door and a pair of narrow side openings on either side of the central opening for receiving sidelight windows. Mull posts typically are formed of a pair of back-to-back wooden supports that have been milled along their exposed faces to provide stops for abutting a closed door or receiving and securing the sidelight windows. A strip of decorative molding is commonly nailed along the outside edges of the supports to cover there outside edges, to cover the junction between the supports, and to lend a pleasing appearance to the finished casing.

A traditional method of fabricating door jambs is to mill the jambs from larger pieces of a high quality clear wood. In this process, a relatively thick piece of wood for each jamb of the casing is passed through a milling machine and unwanted portions are cut or milled away and discarded as sawdust. The milling process produces the raised stops and other structural features of the jambs. Obviously, this process is wasteful and is becoming more expensive in light of the ever-increasing cost of lumber. In some instances, the entire cross-section of each jamb, including the brickmold, is milled from a single length of thick lumber. In other instances, the jambs are milled from two or more pieces of wood to form the frame and stop and a separate decorative brickmold. The brickmold is then nailed to the frame and stop to form the finished jamb profile. In either case, significant amounts of expensive lumber are required as is time consuming, expensive, and wasteful machining steps.

In the past few years, dwellings with thicker outside walls have become popular because thicker walls accommodate more insulation and thus provide higher R-values. The use of thicker walls has given rise to a requirement for correspondingly thicker door casings that span the width of the wider walls. For casing made from wooden jambs, this has meant the use of even wider boards to fabricate the jambs with the wider boards being milled to produce the stops and perhaps the brickmold of the casing. Typically, this is an even more wasteful process than milling jambs for traditional narrower casings since more wood is used and, in many instances, more wood is milled away.

All of this adds to the final cost of traditional door casings. Further, and perhaps even more pertinent, the exposed wooden brickmold and the exposed portions of molding along the mull posts of side light casings require periodic painting and maintenance in order to prevent rotting as a result of exposure to the weather. Even with the most careful maintenance, these exposed wooden portions of can, over time, begin to rot from within, whereupon the entire door casing usually must be replaced. Rot due to moisture can be a particular problem at the bottom ends of the side jambs where they meet and are secured to a doorsill. Rain water that runs down onto the door sill tends to be wicked into the bottoms of the side jambs causing rot.

Casings have been developed that are wholly or partially comprised of extruded thermoplastic portions. For example, U.S. Pat. No. 4,430,830 to Sailor teaches a casing for mounting a window or door in an opening of an existing structure. The casing is made of jambs that include an extruded plastic or metal outer frame forming the stop and a wooden inner frame to which the outer frame is attached. Fasteners such as screws are provided for attaching the outer frame to the rough framed opening and a molded decorative cover is provided for concealing the fastners, in Sailor, the portion of the outer frame forming the stop and brickmold are hollow and thus provide little enhanced strength or rigidity to the frame. Further, the hollow brickmold makes it unsuitable for receiving standards nails for securing the casing to the building. Non-carpentry standard installation techniques are thus required, which is distasteful to many carpenters. In addition, the casing of Sailor requires the use of an auxillary cover to conceal the fastners attaching the frame to the building structure.

U.S. Pat. No. 5,058,323 to Gerritsen teaches a casing wherein a plastic member wraps around a wooden jamb with a milled stop or that wraps around a wooden jamb and provides its own plastic stop. An attachable brickmold is also included. This casing, like that of Sail or, has flimsy hollow portions unsuitable for holding nails and liable to be punctured or otherwise deformed by heavy use or forcible contact. U.S. Pat. No. 5,182,880 to Berge, Jr., et al., teaches a cladded jamb similar to that taught by Gerritsen in that it wraps around a traditional wooden jamb and stop. Thus, a fully milled wooden jamb is still required.

U.S. Pat. No. 5,661,943 of Hagel discloses a milled wooden door casing wherein the bottom sections of the side jambs are formed from a composite material made of wood particulate that is mixed with resins. These bottom sections are milled or otherwise formed to have the same profile as the wooden portions of the jambs and are joined to the wooden portions with finger joints. A goal of this jamb structure is to address the problem of rot and decay at the bottoms of the sides jambs where the side jambs meet the sill. While the Hagel frame is an improvement in this regard over traditional all wooden jambs, it nevertheless has its own inherent problems and shortcomings. For example, The finger joint that joins the composite bottom sections to the side jambs tends to be relatively weak and can be broken off, especially prior to the attachment of brickmold after installation of the casing. In addition, the side jambs and head jamb must still be milled to define their finished profile after the composite bottom sections are joined. Obviously, this does not address the problems of waste and expense.

SUMMARY OF THE INVENTION

Briefly described, the present invention, in a preferred embodiment thereof, comprises an improved door jamb assembly for constructing a door casing. The jamb assembly comprises a frame member preferably formed of a relatively flat wooden board having inside and outside faces and inside and outside edges. A substantially solid extruded plastic brickmold and stop member is mounted to the frame member and is profiled to define the raised stop and brickmold of the assembly. The wooden frame member provides a traditional wooden surface and provides a solid structure for receiving nails and screws when mounting the casing and hanging a door from a side jamb thereof. The brickmold and stop member can be extruded as a single unitary piece, which is preferred in some cases or can be extruded as separate pieces joined with fasteners or adhesive.

The brickmold and stop member in the preferred embodiment is profiled to define a leg that at least partially overlies the inside face of the frame member to which it is attached and that defines a raised stop relative to the inside face for abutting a closed door. The brickmold and stop member is also profiled to define a decorative brickmold that frames the casing on the outside of a building in which the casing is installed. The extruded brickmold and stop member is adhered or otherwise firmly mounted to the wooden frame member so that together they form a traditional profiled door jamb.

The brickmold and stop member is co-extruded from a thermoplastic material and preferably has a relatively less dense blown thermoplastic core covered by a relatively more dense plastic outer skin or covering. The density of the blown core is sufficient to receive and hold a traditional finishing nail so that the assembly can be nailed in place through the brickmold in the traditional way. In one embodiment, the brickmold is co-extruded with a relatively hard plastic flange or tab that projects outwardly from the assembly and that is positioned to overlie the outside surface of a building around the rough door opening. During installation, the casing is positioned in the opening with its flanges disposed against the outer wall of the building, whereupon the flanges are fastened with nails or screws. Brick, lap board, or another exterior finish can then be applied over the flanges abutting the brickmold to result in a traditional looking exterior door casing. Preferably the stop is extruded with a groove or slot that extends along the stop adjacent the inside face of the frame member for receiving and holding the mounting tab of a length of weather stripping.

In another embodiment of this invention, the decorative brickmold has an exposed outer surface and an inner surface that is formed to define a recess. A stabilizer, such as a strip of wood, is disposed in the recess for stabilizing the brickmold and for providing a more secure medium through which attaching nails can extend. A short tab is co-extruded with the brickmold and stop member and the tab extends partially over the outside face of the wooden frame member. Staples can be driven through the tab and into the wooden frame member to attach the brickmold and stop member firmly and securely to the frame member. In one embodiment, the inside face of the wooden frame member is milled with a recessed dado and the brickmold and stop member is provided with a projection sized to be received in the recessed dado. Staples can be driven through the projection and into the wooden frame member for attachment of the brickmold and stop member to the frame member.

In still another embodiment, the mull posts of a side light door casing are each formed from a flat back-to-back wooden frame member. A generally U-shaped extruded thermoplastic molding and stop member is secured to the frame members along the outside edges thereof. The legs of the molding and stop member overlie a portion of the exposed faces of the frame members and form elongated stops that extend along the length of the mull posts intermediate the inside and outside edges thereof. The bight portions of the molding and stop members cover the outside edges of the frame members and provide a decorative appearance to the exposed portions of the mull posts. The stop formed along one face of the mull post abuts a closed door mounted in the opening of the casing and the stop along the other face of the mull post provides a surface against which side light windows can be mounted in the casing. In one configuration, the exposed faces of the mull posts are milled with recessed dados extending along their lengths and the extruded molding and stop members are provided with projections that extend into the milled recesses to hold the molding and stop member in place on the mull posts. Nails or staples can be driven through the projections if desired and into the frame members to hold the molding and stop members in place.

In yet another embodiment, the vertical side jambs of a door casing are formed from wooden frame members having extruded plastic brickmold and stop members attached along their outside edge portions as described above. In this embodiment, however, the immediate bottom portions of the vertical frame members include an extruded thermoplastic attachment that has a relatively less dense blown plastic core covered by a relatively more dense plastic skin. Each attachment is secured to the bottom of its respective frame member with a tongue and groove joint and the extruded brickmold and stop member spans the joint between the attachment and the wooden portion of the frame member. As a result, the bottom portions of the side jambs where the jambs meet a doorsill are plastic and are thus immune to rot and decay. Further, the relatively weak joint between the wooden portion of the frame member and its plastic bottom section is strengthened and reinforced because the extruded brickmold and stop member spans the joint and is fastened both to the wooden portion of the frame member and to the plastic bottom section. As a result, the assembly is rigid and strong and not subject to being broken during installation.

An additional embodiment of the door jamb assembly is designed to form a casing that is deeper for use with thicker walls. This embodiment comprises substantially the same components as the embodiment of FIGS. 1 and 4 except that the wooden frame members are wider to span a thicker wall of, say, six inches rather then the traditional four. In order to adapt the standard extruded stop member to the wider jamb, an extruded extender is provided. The extender is adapted to abut the raised stop of the standard stop member and extend therefrom to an opposite edge, which forms a secondary raised stop relative to the face of the frame member. In this way, the standard extruded stop member is extended and a standard set of components can be used to accommodate either a standard depth or an extended depth casing.

Thus it is seen that an improved door jamb assembly is now provided wherein the need to mill or otherwise machine the stops, molding, and other portions of the jamb is eliminated. A relatively inexpensive flat board forms the frame of the assembly. The stop members and the decorative molding portions of the jamb assembly are formed from thermoplastic co-extrusions that look, feel, and hold nails like wood but that require substantially less maintenance than wood and are not subject to rot or deterioration as is wood. The jamb assembly is used to fabricate a door casing that can be installed with finish nails in the same way as a traditional wooden casing. This is an advantage to carpenters, who prefer traditional installation methods to new or complex alternate methods. As an added advantage, the bottom sections of the side jambs that meet and are attached to a doorsill are formed of extruded plastic material that is immune to rot and deterioration. Finally, a standardized extruded extension is provided to adapt the standard width stop member to a deeper casing for use with thicker walls. These and many other objects, features, and advantages will become more apparent upon review of the detailed description set forth below taken in conjunction with the accompanying drawings, which are briefly described as follows.

DETAILED DESCRIPTION OF THE PREFERRED EMBODIMENTS

Figure 1:
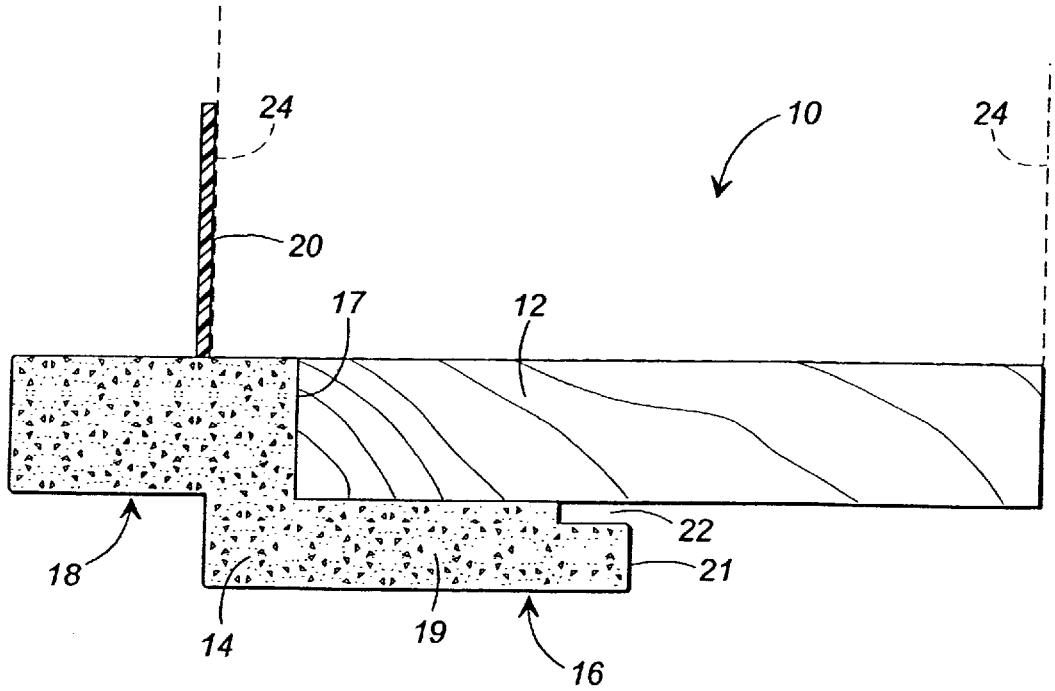
FIG. 1 is a cross-sectional view of a door jamb and brickmold assembly that embodies principles of the present invention in a preferred form.

FIG. 1 is a cross-sectional view of a door jamb assembly that embodies principles of the present invention in a preferred form. It will be understood that a complete door casing is formed from three door jamb assemblies secured together to form the vertical side jambs and horizontal head jamb of a doorway opening. The portion of the door jamb assembly on the right in FIG. 1 resides on the interior of a building in which a casing is installed and the portion on the left, known as the brickmold, resides on the outside of the building.

The door jamb assembly 10 comprises a frame member 12 in the form of an elongated relatively thin rectangular board. In the preferred embodiment, the frame member 12 is made of a flat wooden board. Such construction provides a traditional appearance on the inside of the building structure and also provides for traditional fastening of a door casing to a framed-in opening with nails or screws. However, material other than wood could be used for the frame member with comparable results. The use of wood for the frame member 12 is not disadvantageous as the milled wooden doorjambs of the prior art. This is because the frame member in this invention is a simple flat board that does not require any special and expensive machining or milling and that is readily available at reasonable cost and in standard sizes.

A brickmold and stop member 14 is securely fixed with adhesive or other appropriate fastening means along the outer edge portion of the frame member 12. The brickmold and stop member 14 is formed of a suitable thermoplastic material that has been co-extruded through a plastic extruder head to have the exterior shape and profile shown in FIG. 1. Preferably, the co-extrusion that forms the brickmold and stop member 14 is substantially solid with the interior portion thereof being extruded of a relatively less dense blown thermoplastic material and with the exterior skin being a relatively more dense non-blown thermoplastic material. The interior thermoplastic material is extruded with a blowing agent with proper characteristics to result in a density and consistency sufficient to receive and hold a traditional finishing nail or the like. The exterior skin of the brickmold and stop member 14 provides a resilient surface that is resistant to impacts while at the same time provides an excellent surface for receiving primers and paints. Blowing and extruding techniques are well known and any suitable technique and combination of materials may be used in the present invention.

The brickmold and stop member 14 is formed to define a rabbet 17 that is shaped and sized to receive the outside edge portion of the frame member 12 as shown. The rabbet 17 defines a leg 19 of the brickmold and stop member 14 that overlies a portion of the exposed face of the frame member 12 and extends to approximately the mid-portion thereof. The leg 19 terminates in an edge 21 that extends outwardly from and perpendicular to the inside face of the frame member 12. With this configuration, the edge 21 of the leg 19 forms a raised stop that extends along the frame member and around the interior of a door casing. In use, a door mounted to the jamb assembly, when closed, rests against the stop, as it would against the milled stop of a prior art all-wooden jamb assembly.

Preferably, the edge 21 of the leg 19 is formed with a narrow rabbet 22 that, in conjunction with the face of the frame member 12, defines a groove or slot that extends around the frame member at the intersection of the stop and the frame member. The groove formed by the rabbet 22 is sized and shaped to receive the mounting tab of a length of traditional weather stripping material, which seals against a closed door resting against the stop 21. Thus, the mounting tab of the weather strip is both concealed and secured firmly to the assembly in the groove formed by the rabbet 22.

The other end of the brickmold and stop member 14 is profiled to define a decorative brickmold portion 18. The brickmold portion 18 is sized and shaped to extend outwardly from and generally transversely with respect to the outer edge of the frame member so that it frames the entire door casing on the outside of a building to which the casing is attached. An elongated flap or tab 20 (FIG. 1) is co-extruded with and is an integral part of the brickmold and stop member 14. The tab 20 projects from the brickmold and stop member 14 and is formed of a relatively dense rigid plastic material that is adapted to receive and hold nails or screws. The tab 20 allows the door casing to be mounted within a framed opening of a building, indicated by the numeral 24, with the tab 20 being secured by nails or screws to the framing studs around the exterior of the opening. If desired, a sealant can be applied between the tab 20 and the framing of the building to provide an airtight seal against drafts that might otherwise enter the building. The tab 20 also serves to hold the brickmold and stop member 14 securely in place around the periphery of the opening.

Once the assembly is installed with the tab securely fixed, the tab 20 is covered with brick, siding, or other facade as selected by the builder. Such facade abuts the back edge of the brickmold portion 18 and, in the case of brick, can even extend forwardly of this portion. Thus, the appearance of a traditional milled wooden brickmold is presented.

The door jamb assembly illustrated in FIG. 1 can be substantially more economical to produce than traditional all wooden milled jamb assemblies depending, of course, on milling costs and the cost of lumber. Equally as important, the extruded plastic material of the brickmold and stop member 14 is not subject to rot or deterioration as is wood and can, if desired, be colored or tinted so that it does not require painting or other maintenance. In addition, the door jamb assembly illustrated in FIG. 1 is far superior to prior art assemblies that attempt to combine extruded plastic portions with wooden portions wherein the plastic portions are hollow or otherwise insufficient for receiving and holding traditional fastening means such as nails or screws. Further, an environmental advantage is provided by this invention in that a single board is used for the frame member 12. This eliminates the need to start with a much thicker and wider board and mill it down in a wasteful process of forming a milled wooden door jamb assembly. Accordingly, much less wood is used and wasted, which contributes to conservation of the environment. Finally, the co-extruded brickmold and stop member 14 is rugged, strong, able to receive and hold a nail, and provides all of the advantages of wood with the additional advantage that it is not subject to rot and vermin and has a surface particularly suited to application of primer and paint.

Figure 2:
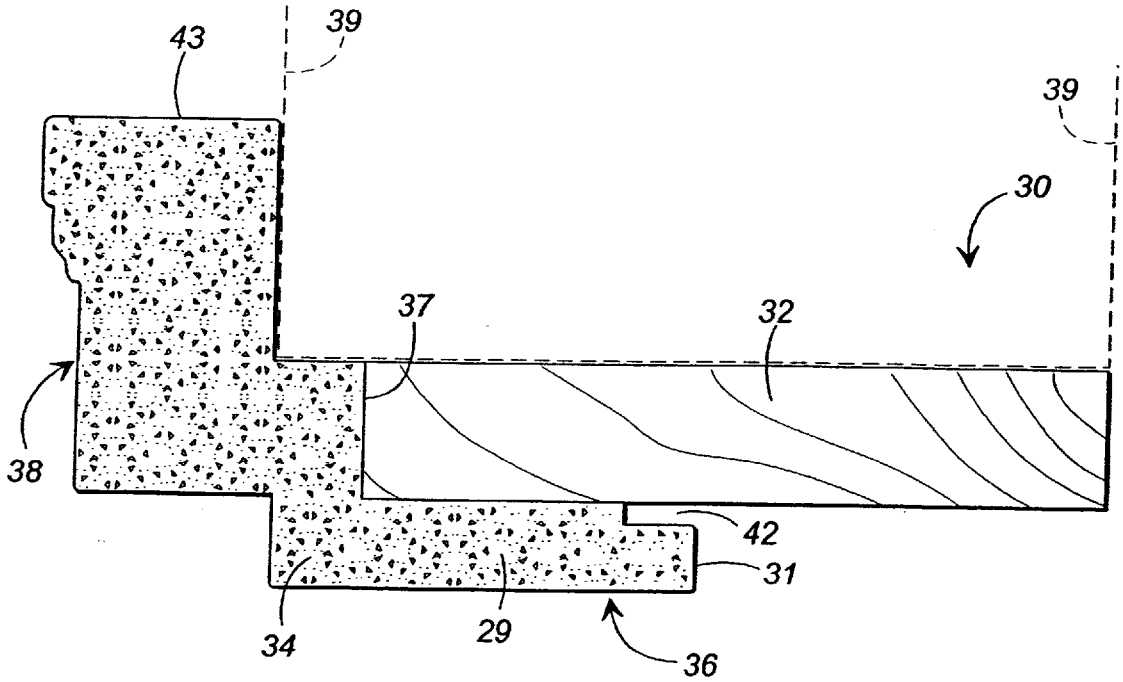
FIG. 2 is a cross-sectional view of a door jamb and brickmold assembly that embodies principles of the present invention in an alternate form.

FIG. 2 illustrates another preferred embodiment of this invention having a second type of decorative brickmold formed by the co-extruded thermoplastic brickmold and stop member. In this embodiment, as in the embodiment of FIG. 1, a rectangular relatively thin wooden frame member 32 has attached thereto by adhesive or other suitable means a co-extruded thermoplastic brickmold and stop member 34. The brickmold and stop member 34 is formed with a wide rabbet 37 that receives the edge portion of the frame member 32. The rabbet 37 defines a leg 29 that overlies a portion of the face of the frame member 32 and extends to approximately the mid-portion thereof. The edge 31 of the leg 29 forms a raised stop relative to the face of the frame member for abutting a closed door. A small narrow rabbet 42, in conjunction with the face of the frame member 32, forms a narrow groove extending along the length of the stop for receiving and holding the mounting tab of a length of weather stripping.

In the embodiment of FIG. 2, the securing tab 20 of FIG. 1 is eliminated and replaced by a decorative brickmold portion that extends outwardly from the jamb assembly and overlies the exterior framing studs 39 of the building in which the assembly is installed. Since the co-extruded brickmold and stop member 34 is formed with a relatively less dense blown core and a relatively more dense outer skin, it is uniquely suited to receive and hold a common finishing nail. Accordingly, such a nail can be driven directly through the brickmold portion 38 of the member 34 and into the stud 39 to secure the front of the casing in place to the stud. The embodiment of FIG. 2 more closely parallels one traditional decorative design for a door casing. As with the embodiment of FIG. 1, brick, siding, or other facade is secured to the exterior of the building after the casing has been installed and the facade abuts the brickmold portion in the traditional way.

Figure 3:
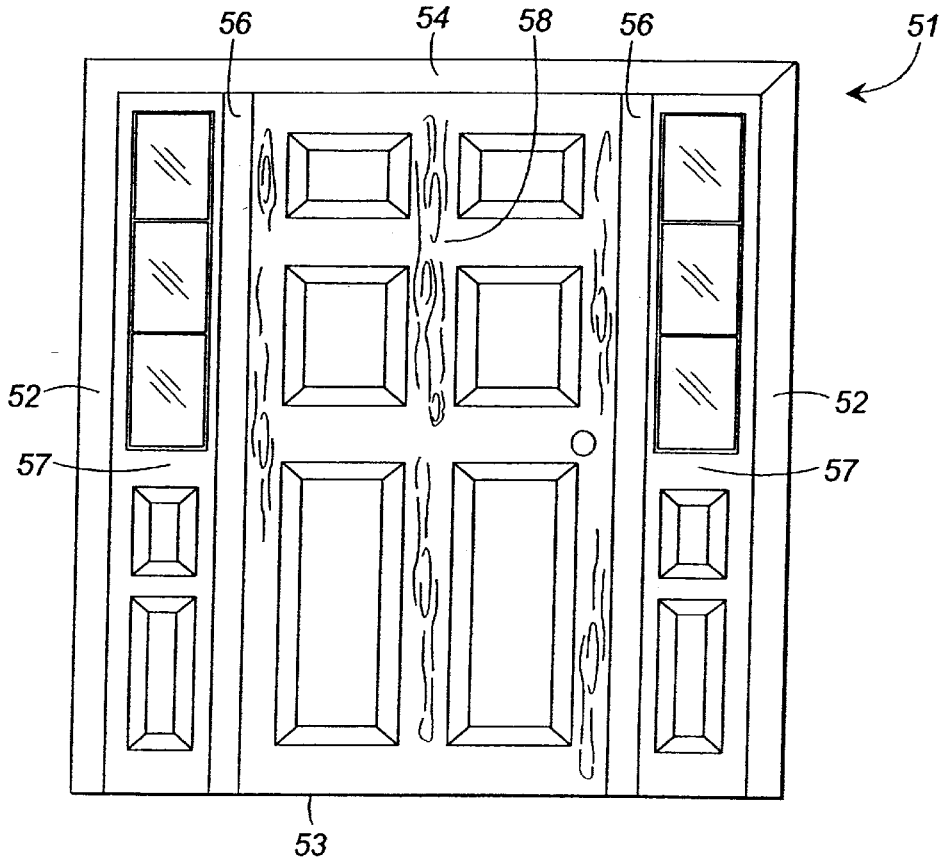
FIG. 3 illustrates the configuration of a typical side light door casing wherein vertically extending mull posts form the door and side light window openings of the casing.

FIG. 3 illustrates a typical door and door casing of the type that has a central hinged door 58 and side light window panels 57 that flank the door on either side. The door casing of FIG. 3 comprises a pair of vertical side jambs 52 that extend between a sill 53 and a head jamb 54. Together, the jambs 52 and 53 and the head jamb 54 define the outer peripheral frame of the door casing. A pair of spaced mull posts 56 extend vertically between the sill 53 and the head jamb 54 and define a central opening in which the hinged door 58 is disposed and two flanking side openings on either side of the central opening for receiving the side light window panels 57. Much of the immediately following discussion refers to a side light door and door jamb assembly of this type.

Figure 4:
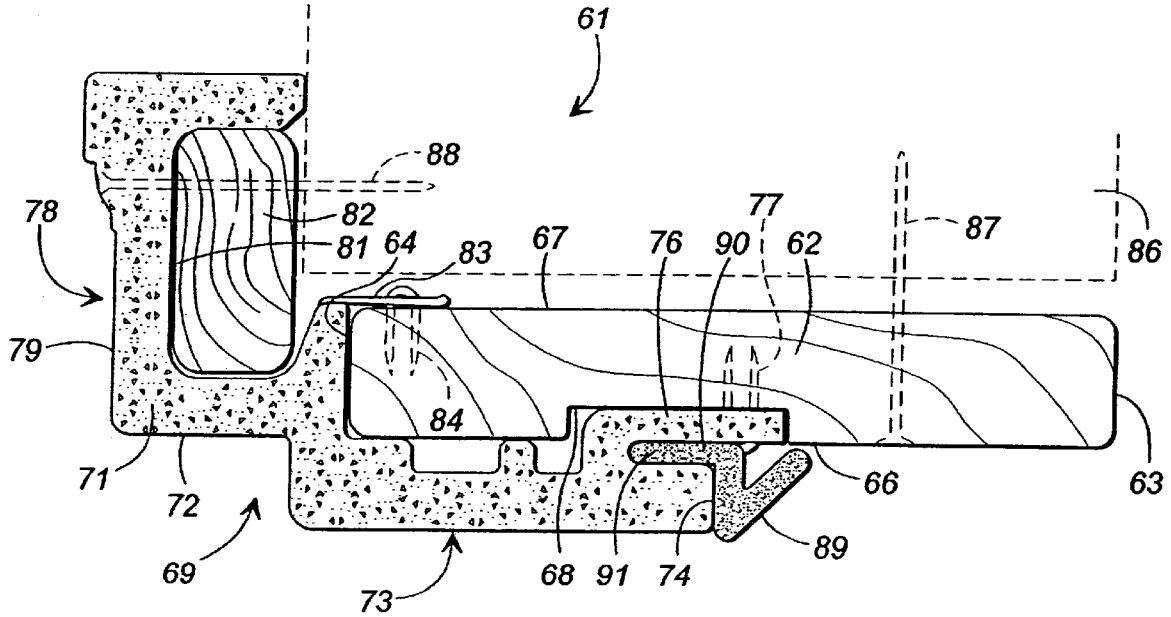
FIG. 4 is a cross-sectional view of a door jamb and brickmold assembly that embodies principles of the present invention in another alternate form.

FIG. 4 illustrates in cross section a door jamb assembly that embodies principles of the present invention in one preferred form. The door jamb assembly of FIG. 4 is used in fabricating a door casing and might, for example, comprise the side jambs 52 and the head jamb 54 of the assembly shown in FIG. 3. Alternately, this configuration might be the side jambs and head jamb of a door casing that did not contain the side light openings of FIG. 3.

The door jamb assembly 61 comprises a frame member 62 having an inside edge 63, an outside edge 64, an inside face 66, and an outside face 67. In the preferred embodiment, the frame member 62 comprises an elongated relatively thin wooden board. However, the frame member could also be made of other materials such as extruded plastic or particleboard. A recessed dado 68 is formed in the outside face 66 of the frame member 62 and extends along the length thereof.

An extruded thermoplastic brickmold and stop member 69 is mounted to the frame member 62 and extends generally along the outside edge 64 thereof. The brickmold and stop member 69 preferably is co-extruded through an appropriate plastic extruder head to have a relatively less dense blown plastic core 71 and a relatively more dense plastic skin 72. The brickmold and stop member 69 is configured to define a leg 73 that overlies a portion of the inside face 66 of the frame member 62 and that extends approximately to the midsection thereof. The edge 74 of the leg 73 defines a raised stop relative to the inside face 66 of the jamb member. The raised stop provides a rim against which a door or side light window panel rests when installed in a door casing.

The leg 73 of the brickmold and stop member 69 is further formed with a projection 76 that is positioned and configured to be received in the recessed dado 68 formed along the inside face 66 of the frame member. Preferably, the projection 76 extends beyond the end 74 of the leg 73 to provide a tab through which fasteners such as staples 77 can be driven to attach the projection and thus secure the brickmold and stop member 69 to the frame member 62. Naturally, fasteners other than the staples illustrated in the preferred embodiment can also be used. For example, the projection might be fastened with nails, adhesive, or any other appropriate means of fastening it within the dado 68. Alternately, the recessed dado 68 and the projection could be shaped to snap together, thus eliminating fasteners altogether.

Preferably, the projection 76 is spaced from the bottom surface of the leg 73 so as to provide a slot 90 that extends along the length of the brickmold and stop member. The slot 90 provides a receptacle for the mounting tab 91 of a length of weather stripping 89. When a closed door or side light window panel is installed against the weather stripping 89, the weather stripping provides a seal against drafts and cold. Furthermore, with the configuration of the projection 76, the weather stripping 89 covers and hides the heads of staples 77 so that they are not visible to an observer. This configuration provides the further advantage that the manufacturer need not countersink the fasteners and fill the holes to hide them from an observer.

The brickmold and stop member 69 is further configured to define a decorative brickmold portion 78 that projects beyond the plane of the outside face 67 of the frame member 62. In use, the decorative brickmold portion 78 frames the door casing within a rough opening in which it is installed and overlaps the edge portion of the opening to provide a clean decorative framing. The decorative brickmold portion 78 has an exposed outer surface 79 and an inner surface 81. The inner surface 81 is formed to define a recess and an elongated stabilizer 82 is disposed within the recess extending along the length of the decorative brickmold portion 78. In the preferred embodiment, the stabilizer 82 comprises an elongated strip of wood sized and configured to fit within the recess. However, the stabilizer might well be made of other suitable materials such as plastic or particleboard. During manufacture, it has been found advantageous that the stabilizer 82 be installed by applying adhesive along its outside face and popping it into place within the recess 81 formed in the decorative brickmold portion 78. The stabilizer 82, once installed, stabilizes and strengthens the decorative brickmold portion 78 and also provides enhanced interfibrous holding capacity for a finishing nail 88 used to attached a door casing in the rough opening of the building. The stabilizer also reduces the amount of thermoplastic material that must be used when extruding the brickmold and stop member.

A relatively short elongated tab 83 is co-extruded with the brickmold and stop member 69 and is positioned and configured to extend along and cover a portion of the inside face 67 of the frame member 62 along and adjacent its outside edge 64. Fasteners such as staples 84 can be driven through the tab 82 and into the frame member 62 for securing the brickmold and stop member 69 to the frame member 62. The combination of fasteners 77 and 84 have proven to be more than sufficient to hold the brickmold and stop member 69 securely and firmly to the frame member 62 so that the two components form a strong unitary whole. Furthermore, attaching the brickmold and stop member 69 with staples as shown in FIG. 4 is readily adaptable to standard manufacturing techniques and allows assembly of door jamb quickly and easily during the manufacturing process.

The configuration shown in FIG. 4 is used in forming a door casing that is installed within a rough opening of a building structure in a method substantially the same as prior art milled wooden assemblies. Specifically, the door casing is inserted into the rough opening with the decorative brickmold portion 78 framing and covering the outside edges of the framing studs of the rough opening. The door casing can then be leveled and squared with shims in the usual way, whereupon finishing nails 87 and 88 are driven through the frame member 62 and the decorative brickmold 78 respectively to secure the assembly within the opening. In this regard, as mentioned above, the stabilizer 82 provides an excellent medium through which a finishing nail 88 can be driven and provides additional holding capacity for the nail after installation. Once installed and painted, the door casing presents an appearance virtually identical to that of a prior art milled all wooden assembly with the substantial advantages provided by the co-extruded thermoplastic brickmold and stop members.

Figure 5:
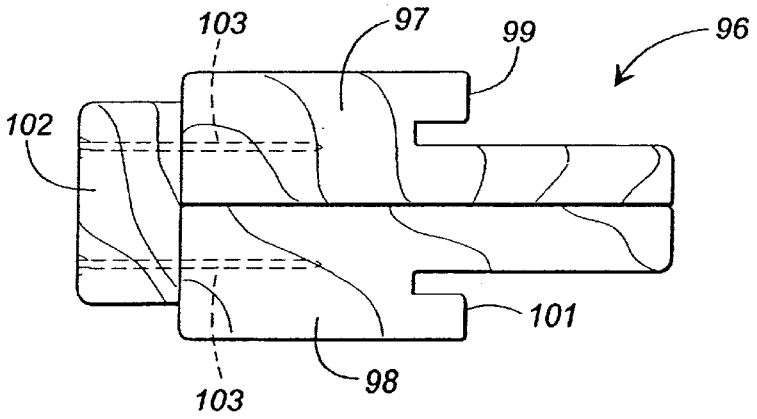
(PRIOR ART) FIG. 5
FIG. 5 is a cross-sectional view of a prior art wooden mull post used in side light door casings.

FIGS. 5 through 9 illustrate application of the present invention to the mull posts of a side light door casing. FIG. 5 illustrates a prior art milled wooden mull posts that has been used for many years. Such mull posts typically are milled from thick wooden boards and comprise a first frame member 97 and a second frame member 98 arranged in back-to-back relationship. The first frame member 97 is milled to define a raised stop 99 that abuts either the door or the side light window assembly, depending upon the side of the door on which the mull post resides. Similarly, the frame member 98 is milled to define a raised stop 101 on the other side of the assembly.

Grooves are milled along the bottoms of the raised stops to receive the attachment tabs of weather stripping. To cover the junction between the two support members and to provide a pleasing aesthetic exterior appearance, a strip of molding 102 is nailed with finishing nails 103 along the front edges of the frame members. The molding 102 can take a variety of decorative shapes but generally functions to cover and protect the junction, to keep water out of the junction, and to provide a decorative surface for paint or other finish. As mentioned above, such prior art mull post assemblies are expensive and labor intensive because of the milling processes that must be performed and are also subject to rot, deterioration, and vermin because of their wooden construction.

Figure 6:
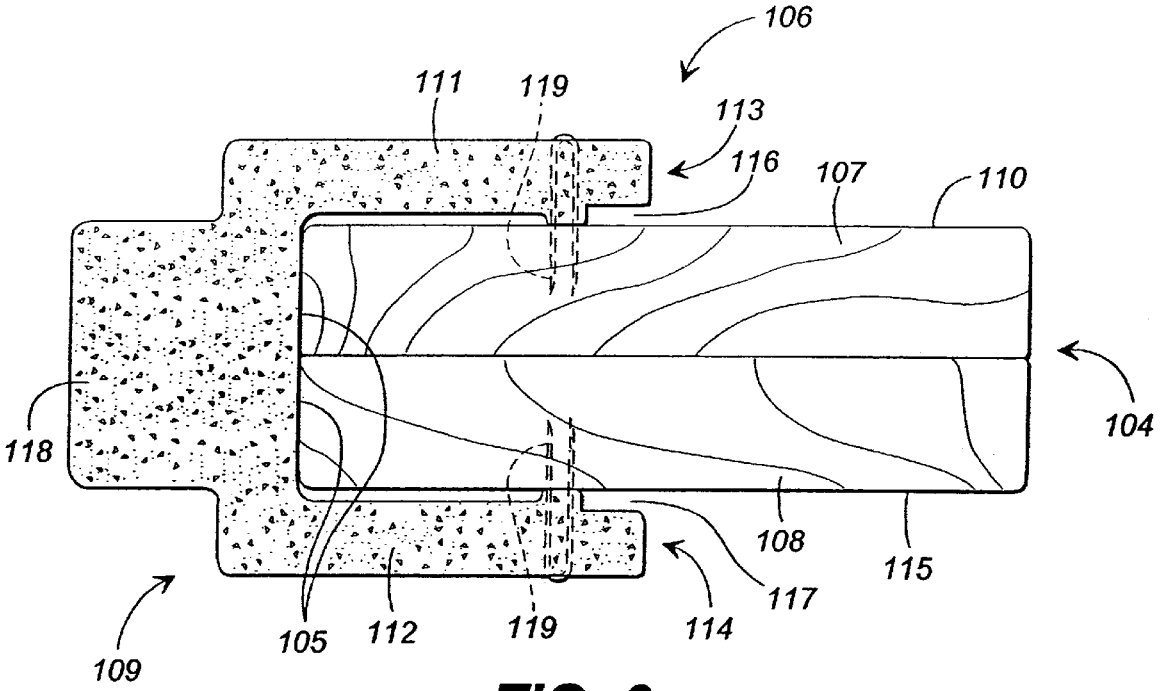
FIG. 6 is a cross-sectional view of a mull post that embodies principles of the present invention in a preferred form.

FIG. 6 illustrates a mull post assembly that embodies principles of the present invention in a preferred form. The mull post assembly 106 comprises a first frame member 107 and a second frame member 108. In the preferred embodiment, the frame members 107 and 108 comprise elongated relatively thin wooden boards that are arranged in back-to-back relationship. Alternatively, the frame members 107 and 108 could be spaced slightly from one another with spacers or the like to allow for leveling and squaring as a door casing is installed in the opening of a building structure. The frame members 107 and 108 have inside edges 104 and outside edges 105. Frame member 107 has an exposed face 110 and frame member 108 has an exposed face 115.

An extruded plastic molding and stop member 109 is co-extruded of an appropriate thermoplastic material and has a relatively less dense blown plastic core covered by a relatively more dense nonblown plastic skin. The molding and stop member 109 is formed to define a first leg 111 that overlies a portion of the exposed face 110 of the frame member 107 and that extends approximately to the midsection thereof. Similarly, a second leg 112 overlies the exposed face 115 of the frame member 108 and also extends approximately to the midsection thereof. The end 113 of the first leg 111 forms a raised stop relative to the exposed face 110 of the support member 107 and the end 114 of the leg 112 defines a similar raised stop relative to the exposed face 115 of the frame member 108. Further, the end portion of the leg 111 is formed with a narrow rabbit 116 that, in conjunction with the face 110, defines a slot that extends along the length of the mull post assembly. Rabbit 117 forms a similar slot that extends along the length of face 115 on the other side of the mull post assembly. Slots 116 and 117 are sized to receive the attaching tab of a length of weather stripping for sealing against a door or side light window frame installed against the stop.

Fasteners, such as staples 119, extend through the legs 111 and 112 and into the wooden structure of the frame members 107 and 108. In this way, the molding and stop member is firmly secured to the frame members to define the finished structure and shape of the mull post assembly. The heads of the fasteners preferably are recessed into the surface of the molding and stop member 109 and the resulting dimples can be filled with traditional fillers before painting. The substantially solid construction of the molding and stop member allows the use of staples, finishing nails, or any other common fastener, which heretofore have been used in all wooden mull posts. Thus, no special tools or fasteners required in the assembly of many prior art devices are required.

The molding and stop member 109 is further formed to define a decorative molding portion 118 that extends along the front of the molding and stop member 109 and that is exposed on the outside of a building in which the jamb and door assembly is installed. In the embodiment of FIG. 6, the decorative molding portion 118 is shaped to mimic a typical mull post such as that shown in FIG. 5. It will be understood, however, that a variety of decorative shapes might be extruded into the decorative molding portion 118 to provide various appearances on the outside of the building. The relatively more dense outer skin of the molding and stop member 109 is selected to be easily primed and painted or, alternately, the outer skin can be dyed during the extrusion process to have a predetermined desired color and to avoid painting and related maintenance long into the future.

Figure 7:
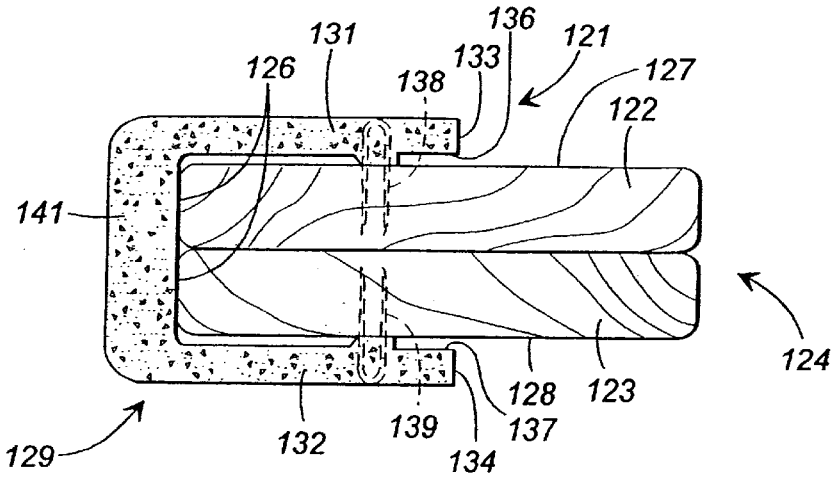
FIG. 7 is a cross-sectional view of a mull post that embodies principles of the present invention in another preferred form.
Figure 8:
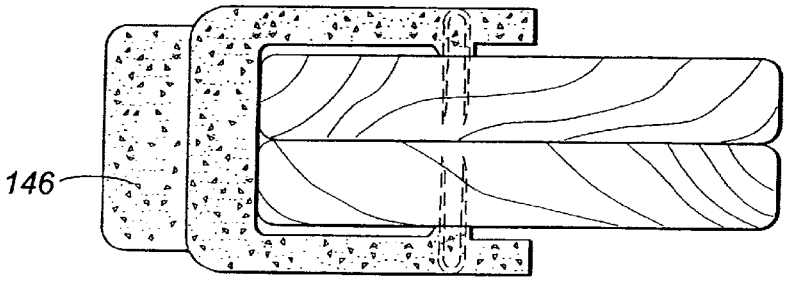
FIG. 8 is a cross-sectional view of a mull post that embodies principles of the present invention in yet another preferred form.

FIGS. 7 and 8 show alternate embodiments of the mull post assembly illustrated in FIG. 6. In FIG. 7, frame members 122 and 123 are arranged in back-to-back relationship. Frame 122 has an exposed face 127 and frame member 123 has an exposed face 128. The frame members 122 and 123 have inside edge portions 124 and outside edge portions 126. A generally U-shaped extruded thermoplastic molding and stop member 129 is fitted over the outside edge portions 126 of the frame members 122 and 123. The molding and stop member 129 has a first leg 131 that overlies a portion of the face 127 of frame member 122, and similarly, leg 132 overlies a portion of the face 128 of frame member 123. Edges 133 and 134 of the legs 131 and 132 respectively form raised stops relative to the respective faces of frame members 122 and 123. Narrow Rabbets 136 and 137 in conjunction with the faces 127 and 128 form slots that extend along the mull post assembly for receiving the attachment tab of weather stripping.

As with the embodiment of FIG. 6, the molding and stop member 129 is attached to the frame members with fasteners such as staples 138 and 139, which hold the thermoplastic molding and stop member securely to the frame members forming the finished mull post. In the embodiment of FIG. 7, the decorative molding portion 141 of the molding and stop member is defined simply by the bight portion of the U-shaped member and no additional decorative molding portion is formed. This configuration might be used for simple door casings not to be festooned with decorative molding.

FIG. 8 illustrates an alternate embodiment of the mull post assembly wherein a separate extruded decorative molding portion 146 is attached to the outside of the byte portion of the molding and stop member with appropriate adhesive. In this embodiment, a standard mull post assembly could be supplied with a wide variety of available decorative moldings, which could be attached with adhesive during construction according to the instructions of particular customers.

Figure 9:
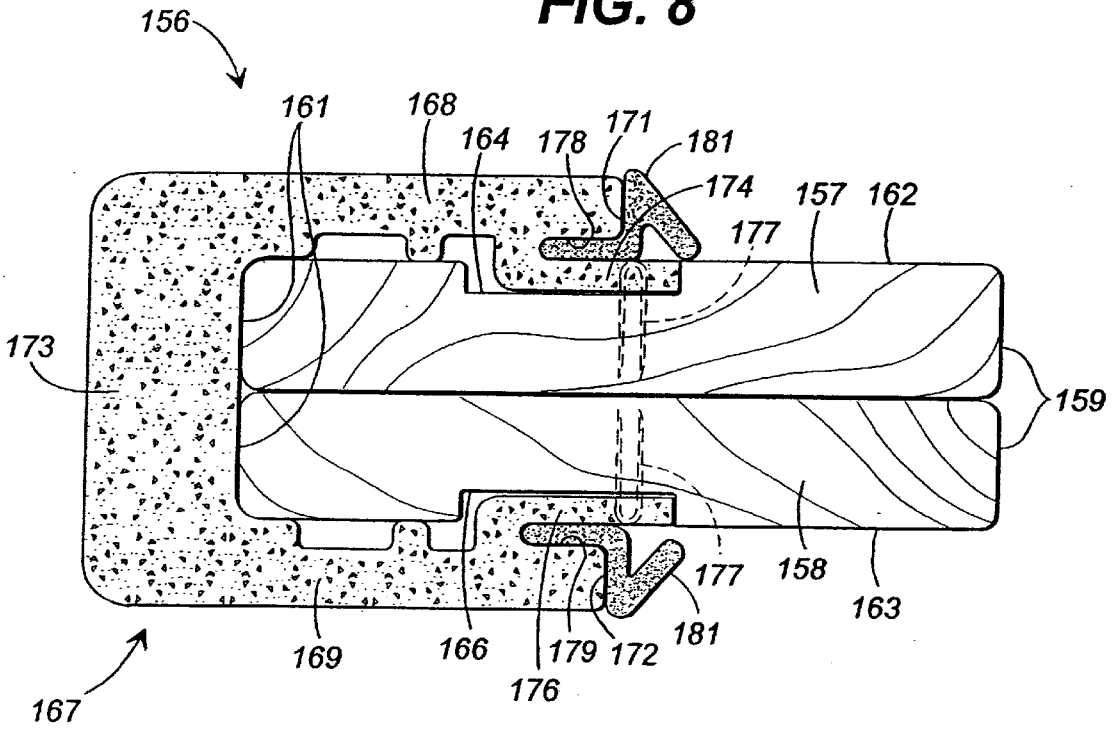
FIG. 9 is a cross-sectional view of a mullion that embodies principles of the present invention in still another preferred form.

FIG. 9 illustrates an alternate embodiment of the mull post assembly of the present invention. This embodiment comprises first and second frame members 157 and 158 respectively that, as with prior embodiments, are arranged in back-to-back relationship with opposed exposed faces 162 and 163. Exposed face 162 is formed with a recessed dado 164 that extends along the length of the frame member 157. Similarly, face 163 is formed with a recessed dado 166 that extends along the length of support frame 158. Frame members 157 and 158 have inside edge portions 159 and outside edge portions 161.

A generally U-shaped molding and stop member 167 is co-extruded of thermoplastic material and has a relatively less dense thermoplastic core covered by a relatively more dense plastic skin. The molding and stop member 167 defines a first leg 168 that overlies a portion of the face 162 of frame member 157 and extends approximately to the midsection thereof. The edge 171 of the leg 168 defines a raised stop relative to the face 162 for abutting a door or side light window frame. A protrusion 174 extends beneath the leg 168 and protrudes a predetermined distance beyond the end 171 of the leg. The protrusion 174 is sized and positioned to be received within the recessed dado 164 with its outer surface substantially flush with the face 162 as shown. This configuration provides a tab through which fasteners such as staples 177 can be driven to secure the molding and stop member to the frame members. A slot 178 is sized to receive the attaching tab of a length of weather stripping 181 and, when installed, the weather stripping covers the heads of the fasteners 177 so that countersinking and filling is not required.

Similarly, leg 169 overlies face 158 and extends approximately to the midsection of frame member 158. The edge 172 of the leg forms a raised stop relative to the face 163 and a protrusion 176 extends beneath the end portion of the leg and beyond the end 172. The protrusion 176, like protrusion 174, is sized and configured to be received in the recessed dado 166 with the outer surface of the protrusion being substantially coextensive with the face 163. Fasteners 177 can be driven through the protrusion 176 and into the frame member 158 to secure the molding and stop member to the support members. Slot 179 receives the attaching tab of a length of weather stripping 181, which, when installed, covers the head of the staples 177.

A decorative molding portion 173 is defined by the molding and stop member 167 and extends along the front or exposed edge of the mull post assembly. In the embodiment of FIG. 9, the decorative molding portion 173 is a simple flat surface. However, the decorative molding portion 173 could be shaped to define any one of a number of decorative surfaces as desired. Alternatively, a separate strip of molding could be applied to the surface of the molding portion 173 with appropriate adhesive or other fastening means.

One advantage of the embodiment of FIG. 9 is that the molding and stop member 167 is firmly secured to the frame members with staples 177 that can readily be applied with standard construction techniques and tools and that are covered with weather stripping in the final product so that the staples do not need to be countersunk and filled. This saves substantial time and money in the construction process and provides an aesthetically pleasing and strong final product.

Figure 10:
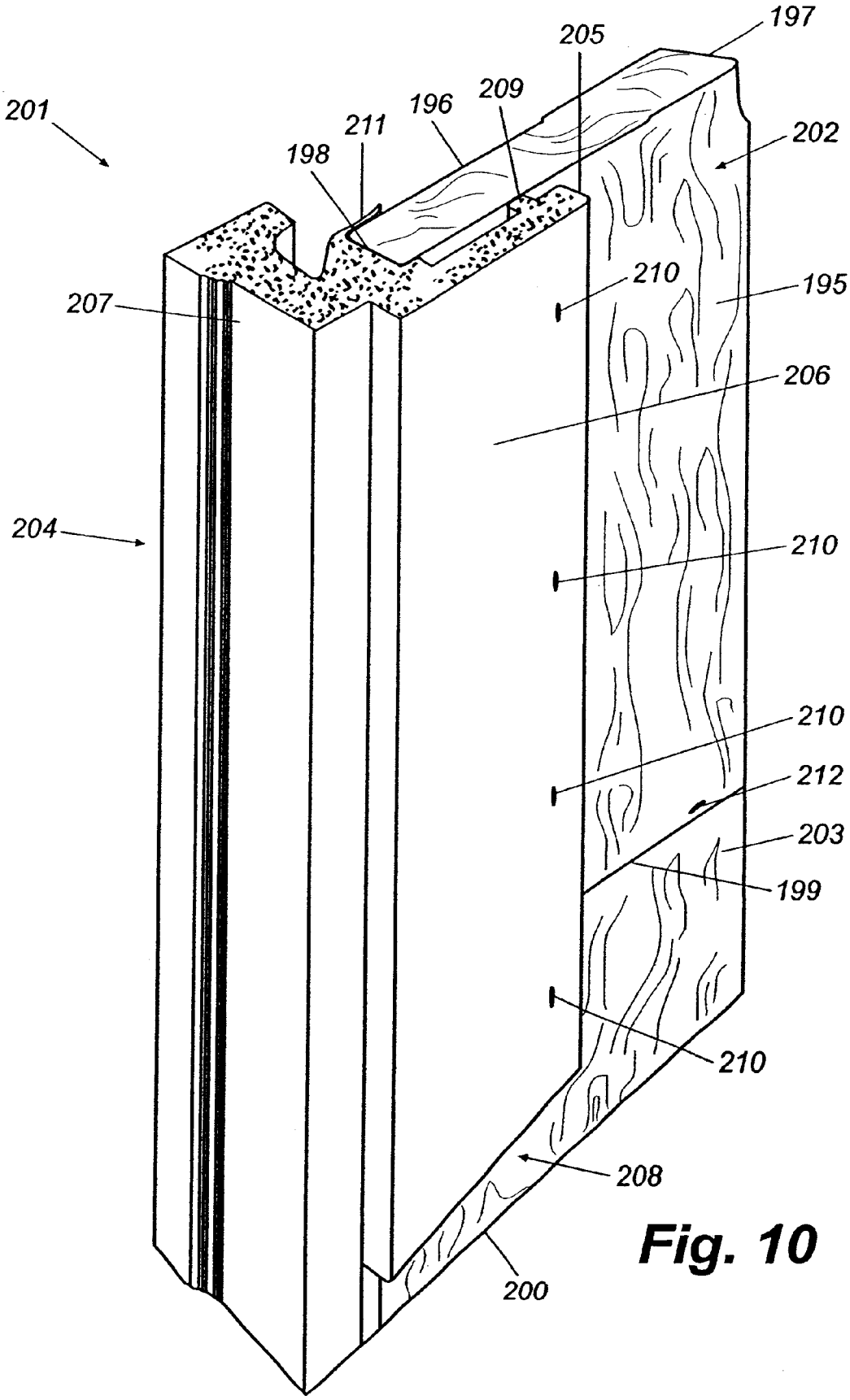
FIG. 10 is a perspective view of the bottom portion of a side jamb illustrating the plastic attachment and its reinforcement by the brickmold and stop member.
Figure 11:
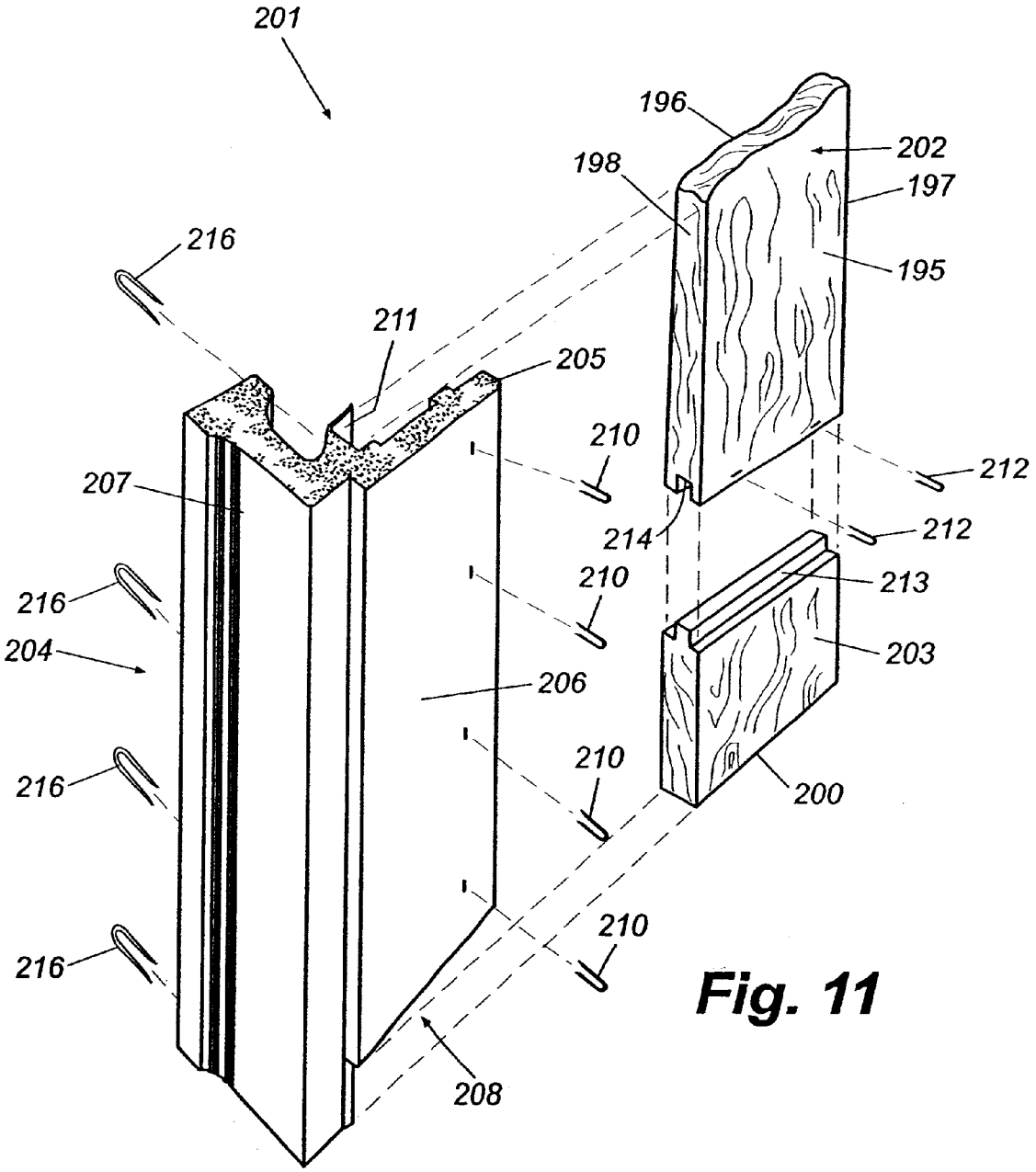
FIG. 11 is an exploded perspective view of the assembly of FIG. 10 illustrating the structural relationship between the components of the assembly.

FIGS. 10 through 13 illustrate another preferred embodiment of the present invention wherein portions of the vertical side jambs that meet and are attached to a door sill are formed entirely of extruded plastic material for durability and resistance to rot and deterioration. FIGS. 10 and 11 illustrate the bottom portion of a side jamb assembly 201 that embodies these principles of the invention. It will be understood that the jamb assembly 201 in reality extends upwardly and meets at its top with a horizontal head jamb that forms the top of the door casing. The jamb assembly 201 is formed from a relatively thin flat wooden frame member 202 having an inside face 195, an outside face 196, an inside edge 197, and an outside edge 198. Thermoplastic extension 203 is joined at 199 to the bottom of the wooden frame member 202 and extends downwardly therefrom to a bottom end 200. The extension 203 has the same cross sectional shape as the wooden board 202 and, in the illustrated embodiment, is formed with an upwardly projecting tongue 213 that is received in a corresponding groove 214 formed in the bottom of the wooden frame member 202. The extension 203 is mounted to the bottom of the frame member 202 by inserting the tongue 213 into the groove 214 and driving staples 212 through the resulting joint. Alternatively, the two pieces could be joined together with adhesive or any other suitable fastening method or device.

A substantially solid extruded plastic stop and brickmold member 204 is secured to the frame member and extends generally along the outside edge 198 thereof. The stop and brickmold member is co-extruded from appropriate thermoplastic material and has a relatively less dense blown plastic core covered by a relatively more dense nonblown plastic skin. The brickmold and stop member 204 is configured to define a leg 206 that overlies a portion of the inside face 195 of the support member and that defines a raised stop 205 against which a closed door mounted in the door casing assembly rests. The leg 206 spans the joint 199 between the wooden board 202 and the plastic extension 203 and has a bottom portion 208 that is contoured to receive and be mounted to the end of a door sill in the traditional way.

The brickmold and stop member 204 of the illustrated embodiment is further configured to define a decorative brickmold 207 as described above relative to other embodiments. It should be understood that the decorative brickmold need not necessarily be a part of the member 204. It could be left off altogether and a traditional wooden brickmold provided or a separate extruded plastic brickmold could be attached with adhesive or fasteners if desired. A hard but slightly flexible plastic tab 211 is co-extruded with the brickmold and stop member 204 and is sized and positioned to overlap partially the forward edge portion of the outside face 196 of the frame member 202. Further, as with the leg 206, the tab 211 spans the joint between the frame member 202 and the extension 203 on the outside of the support member formed thereby.

The brickmold and stop member 204 is securely fastened to the support member formed by the frame member 202 and extension 203 by means of a first array of staples 210 driven through the leg 206 and into the inside surface of the member and a second array of staples 216 driven through the tab 211 and into the outside surface of the frame member. It is significant that the staples 210 and 216 be driven both into the wooden frame member 202 and into the plastic extension 203. It has been found that the spanning of the joint 199 by the brickmold and stop member 204 and the attachment with staples extending both into the wooden board 202 and plastic extension 203 greatly reinforces the inherently weak joint between the wooden frame member 202 and plastic extension 203 forming a rigid monolithic structure that is very strong and able to withstand even the most extreme stresses during handling and installation of the door jamb assembly. While staples have been illustrated as a preferred method of attaching the brickmold and stop member, it will be understood that any suitable attachment mechanism such as, for example, adhesive or nails might be substituted and that such would be equivalent to the illustrated staples.

With the just described construction, it will be understood that a door jamb assembly is now provided wherein the entire bottom end of the jamb assembly is formed of extruded cellular plastic material. Therefore, when the jamb assembly is secured at its bottom end to a door sill, all of the surfaces that are traditionally exposed to water that runs down onto the door sill are made of non-wooden material. As a result, rot and deterioration at the bottom of the jamb due to wicked moisture is eliminated. The composite jamb of this embodiment is thus superior and solves some of the problems of the prior art.

Figure 12:
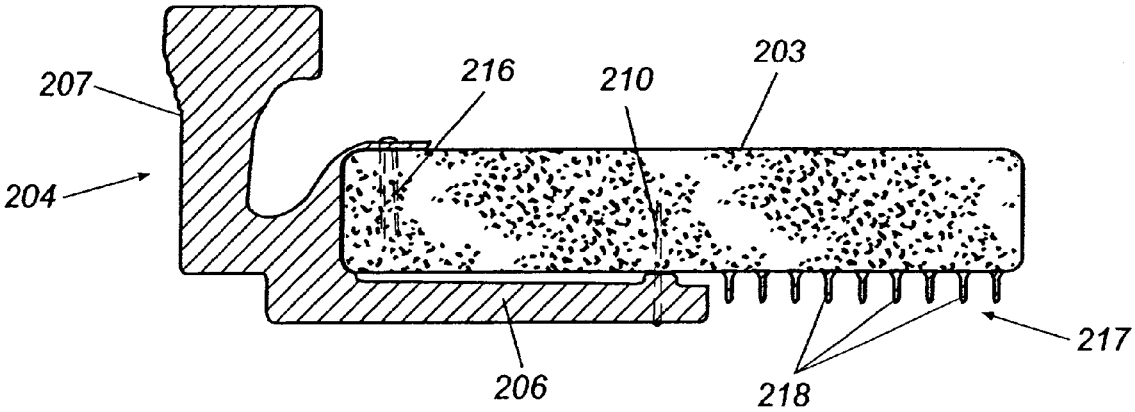
FIG. 12 is a cross sectional view of the bottom section of a side jamb of this invention illustrating one embodiment of a bottom seal formed by flexible fins co-extruded with the plastic bottom attachment.
Figure 13:
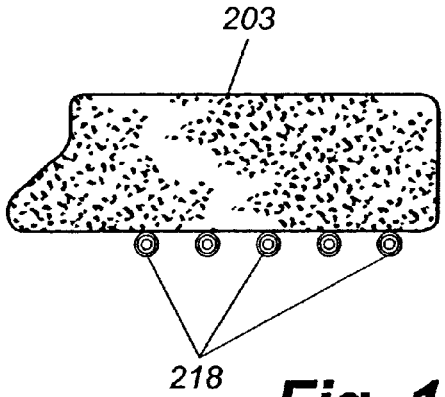
FIG. 13 is a cross sectional view illustrating an alternate embodiment of the co-extruded bottom seal.

FIGS. 12 and 13 illustrate an embodiment of the invention illustrated in FIGS. 10 and 11 wherein a bottom seal is co-extruded with the extension 203 to form a seal between the extension and the bottom outside edge portion of a closed door. FIG. 12 is a cross section through the plastic extension 203 of FIGS. 10 and 11 and shows the brickmold and stop assembly 204 attached by means of staples 210 and 216. An array 217 of flexible fins 218 are co-extruded with the extension 203 and project outwardly therefrom to engage and bear against a closed door mounted in a door casing incorporating the jamb assembly. The fins thus form a seal at the bottom corner of the door adjacent the sill that prevents water from being blown or otherwise driven through the space between the extension and the door, as can sometimes happen in driving or windblown rains. FIG. 13 shows an alternate embodiment of such a seal wherein an array of elongated flexible bulbs 218 are co-extruded on the extension 203. The bulbs 218 are compressed between the extension 203 and the bottom portion of the door edge when the door is closed to form a seal that prevents the migration of water in blowing rains.

Figure 14:
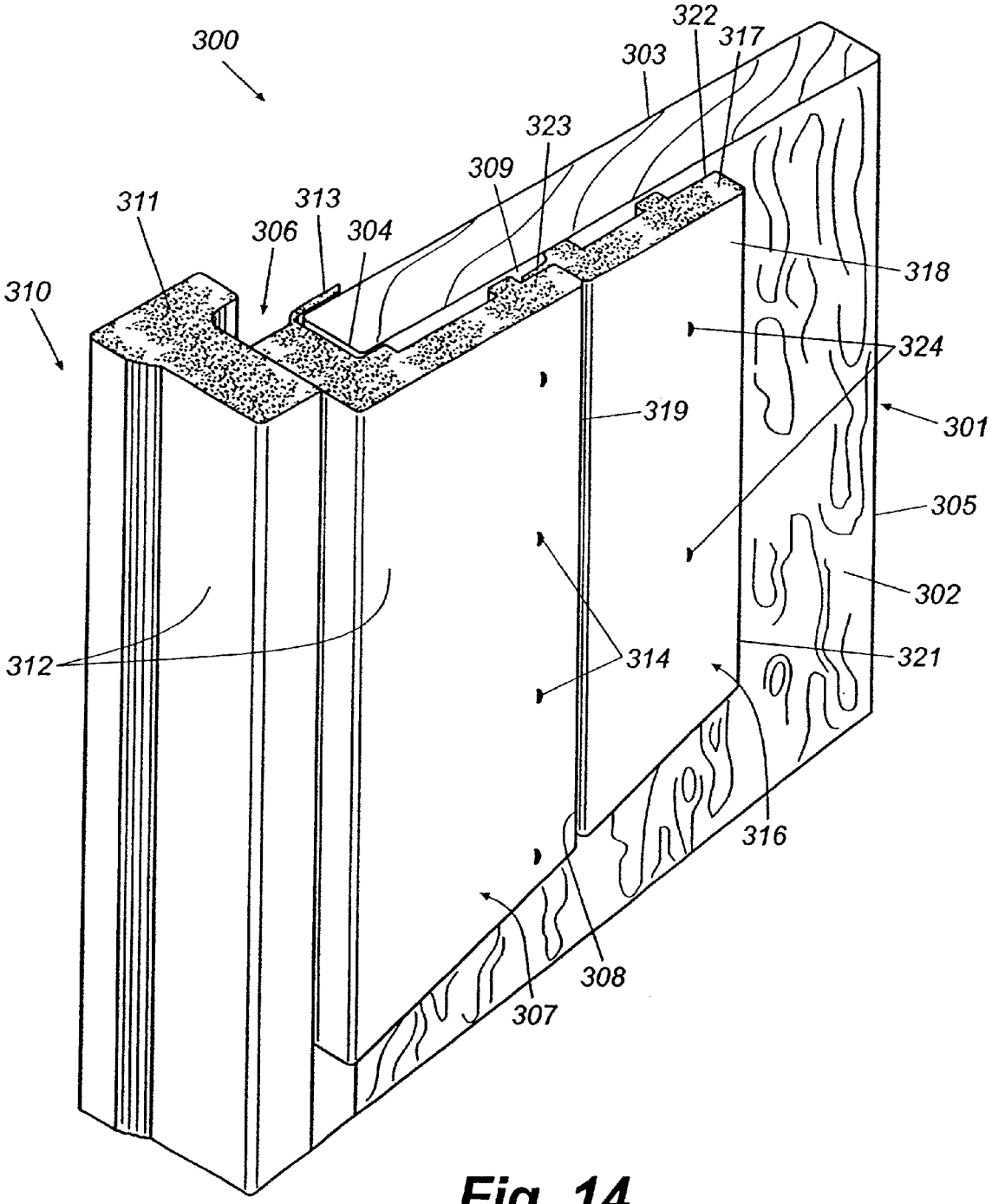
FIG. 14 is a perspective view of a section of a deep casing illustrating the extruded extension for adapting a standard stop member to a wider jamb assembly.
Figure 15:
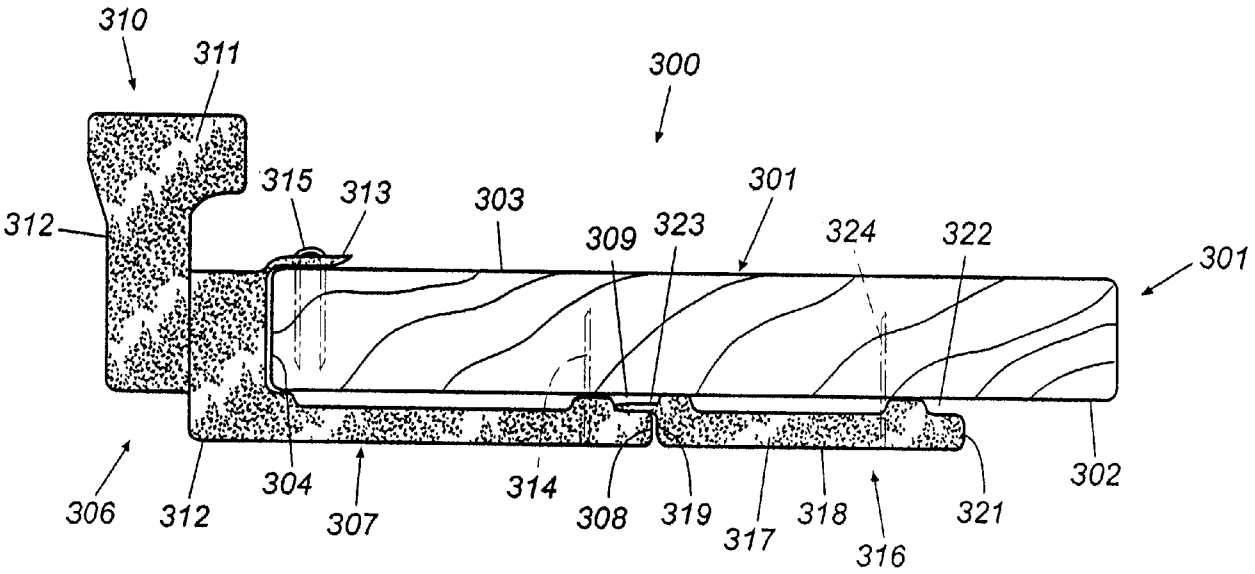
FIG. 15 is a cross-sectional view of the jamb assembly of FIG. 14.
Figure 16:
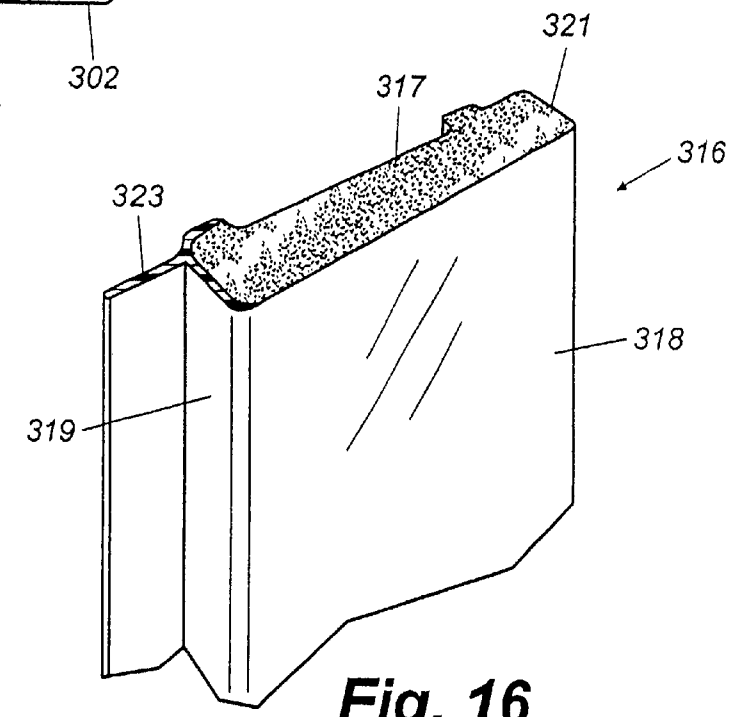
FIG. 16 is a perspective view of a portion of the extruded extension illustrated in FIGS. 14 and 15.

FIGS. 14 through 16 illustrate yet another embodiment of the invention in the form of a wide door jamb assembly used in the fabrication of door casings for use with buildings having thick walls. FIG. 14 shows a section of one of the vertical side jambs of the assembly and it will be understood that the side jambs and head jamb preferably, but not necessarily, have this same configuration throughout their lengths. The door jamb assembly 300 comprises a frame member 301, which, in the illustrated embodiment, is formed of a relatively flat wooden board, but that may also be formed of plastic, composites, or other materials. The frame member 301 has an inside face 302, and outside face 303, and outside edge 304, and inside edge 305. In this embodiment, the frame member 301 is wider than the standard frame members in prior embodiments and results in a deep door jamb assembly designed to be installed in a thicker wall.

An extruded plastic brickmold and stop member 306 is attached to the frame member 301 and extends generally along the outside edge 304 thereof. The brickmold and stop member 306 is similar to the brickmold and stop members of prior embodiments and preferably is profiled to define a leg 307 that overlies a portion of the inside face 302 of the frame member and that has an inside edge 308 that is raised relative to the inside face of the frame member 301. In prior embodiments, this raised inside edge is exposed and forms the raised stop of the door jamb assembly for abutting a closed door. However, in this embodiment, the inside edge 308 is displaced too far from the inside edge 305 of the frame member to serve as the raised stop for the door. This is because a closed door mounting in a door casing incorporating the door jamb assembly must be substantially aligned with the inside edges of the vertical jambs and head jambs.

A narrow groove 309 is formed along the inside edge 308 of the leg 307 adjacent the inside face 302 of the frame member 301. In a standard width doorjamb assembly where the outside edge 308 forms the raised stop of the assembly, the groove 309 functions to receive and hold a length of weather stripping for sealing against the closed door. As with prior embodiments, a decorative brickmold 310 extends along the outside edge portion of the brickmold and stop member to frame an entry in which a door casing is installed. In the embodiment of FIG. 14, the decorative brickmold 310 is shown as a separate plastic extrusion that is fixed to the outside edge of the assembly with fasteners or adhesive. Alternatively, the decorative brickmold 310 and leg 307 could be extruded as a single unitary component attached to the jamb member 301. The decorative brickmold 310 also is extruded with a relatively less dense blown plastic core 311 and a relatively more dense plastic skin 312 adapted to be painted or otherwise treated in the usual way.

A substantially rigid plastic tab 313 is co-extruded with the brickmold and stop member 306 and overlaps a portion of the outside face 303 of the frame member along its outside edge 304. This tab 313 forms a stapling flange through which staples can be driven into the frame member 302 for securing the brickmold and stop member in place on the frame member. In this regard, staples 314 are also preferably driven through the leg 307. It has been found that the combination of staples through the leg and staples through the tab 313 secures the brickmold and stop member firmly to the frame member forming a strong rigid structure.

A separate extruded plastic extension 316 is provided for extending the width of the leg 307 to accommodate the wider door jamb assembly of this embodiment. More specifically, the extension 316 is provided to allow a standard width brickmold and stop member to be adapted to a wider door jamb assembly when necessary without the requirement of extruding a separate and specifically sized wider brickmold and stop member. The extension 316 is also extruded with a relatively less dense blown plastic core 317 and a relatively more dense outer skin 318. The extension 316 has an outside edge 319 and an inside edge 321. A thin groove 322 is formed along the inside edge 321 adjacent the inside face of the jamb member 301 for receiving an securing a length of weather-stripping.

A substantially ridge plastic locking tab 323 is co-extruded with the extension 316 along the outside edge 308 thereof. The locking tab 323 is sized and configured to fit within the groove 309 of the leg 307 when the extension 316 is positioned with its outside edge 319 abutting the inside edge 308 of the leg 307. Preferably, the locking tab 323 is extruded to extend slightly outwardly relatively to the inside face 302 of the jamb member. In this way, the locking tab 323 bears firmly against the groove 309, which holds the extension 316 securely against the jamb member 301 along the outside 319 thereof. Staples 324 can be driven through the extension 316 along the length thereof to secure the extension firmly in place on the frame member 301. It has been found that the staples 324 in conjunction with the locking tab 323 firmly engaged within the groove 309 holds the extension securely in place without the need for further attachment means.

When secured in this way, the extension 316 overlies a portion of the inside face 302 of the frame member 301 and extends from the raised edge 308 of the brickmold and stop member 306 to its inside edge 321, which is spaced from the inside edge 305 of the frame member 301. The inside edge 321 of the extension 316 forms a raised stop relative to the inside face 302 of the frame member 301 for abutting a closed door mounted within a door casing incorporating the door jamb assembly of this embodiment. As mentioned above, the groove 322 receives and holds a length of weather stripping extending around the stop for sealing against the closed door.

With the just described embodiment, a standard sized brickmold and stop member for use with a standard depth door casing can be used without modification on a deep door casing by installing an extension 316 on each jamb assembly of the casing. Extensions 316 can be extruded in a variety of widths to accommodate door casings of standard widths or custom widths. Even though a small crack is visible where the extension meets the brickmold and stop member, this crack has not been found to be objectionable. However, if it is objectionable in some instances, it can easily be filled with an exterior putty or filler at the same time the staple holes 314 and 324 are filled.

FIG. 15 is a cross sectional view of the door jamb assembly of FIG. 14. This view illustrates clearly the use and positioning of staples 314, 315, and 324 for securing the extruded plastic components to the wooden frame member 301. Also clearly illustrated is the relationship between the locking tab 323 and groove 309 for securing the extension 316 firmly in place. Again, the decorative brickmold 310 is illustrated as a separate extrusion attached to the outside edge of the leg 307. Alternatively, the decorative brickmold 310 and the leg 307 could be extruded as a single unitary piece if desired.

FIG. 16 illustrates in more detail the configuration of the extension 316. As previously discussed, the extension 316 is formed of extruded plastic with a relatively less dense blown plastic core 317 and a relatively more dense plastic skin 318. The extension 316 has an outside edge 319 and an inside edge 321, which forms the raised stop of the assembly as described above. The locking tab 323 is co-extruded as a unitary part of the extension 316 and is formed of a relatively rigid yet slightly flexible plastic material. The locking tab 323 is configured, positioned, and oriented to bear firmly against the underside of the groove 309 when the extension is abutted against the inside edge 308 of the brickmold and stop member. The locking tab 323 thus urges the edge portion of the extension tightly and securely against the inside face 302 of the jamb member 301. Staples 32 (FIG. 15) complete the attachment of the extension. With this configuration, the extension is easily attached to the assembly simply by sliding the locking tab 323 into the groove 309, abutting the extension firmly against the inside edge 308 of the brickmold and stop member, and driving staples 324 through the extension as illustrated in FIG. 15.

The invention has been described herein in terms of preferred embodiments. It will be obvious to those of skill in the art; however, that a variety of configurations not illustrated herein might well be implemented within the scope of the invention. For example, the shapes of the projections forming the attachment tabs in the present invention have been illustrated to be simply rectangular. However, a wide variety of shapes might be selected for these projections as well as the recessed dados for receiving them. Further, staples have been illustrated as the preferred attachment means for attaching the extruded thermoplastic portions to the wooden portions. Obviously, any suitable attachment means might be used such as, without limitation, nails, adhesive, or brads. Further, separate fasteners might be avoided altogether by forming the extruded thermoplastic portions of the invention with attaching projections that perform a snapping action within appropriately configured dado grooves formed in the faces of the wooden portions. While such a configuration might be less secure than the preferred fastening means, it would nevertheless provide for quick construction since the molding and stop members could simply be snapped into place on the wooden frame members. In addition, the brickmold and stop member has been illustrated in some of the preferred embodiments as being a unitary extruded plastic piece. It will be obvious to those of skill in the art that the stop portion and the brickmold portion could be separate pieces secured together with nails, staples, or adhesive and that such a configuration would be equivalent to the single extrusion shown in the preferred embodiments. Finally, the preferred embodiments have been illustrated with substantially solid co-extruded thermoplastic molding and stop members having relatively less dense blown cores and relatively more dense skins. While this is preferred for a variety of reasons, the plastic components could just as well be formed of solid nonblown plastic, recycled plastic, or other appropriate materials. It is advantageous, however, that the thermoplastic portions be sufficiently solid to receive and hold nails, staples, and other common fasteners used in the construction industry. These and a wide variety of other additions, deletions, and modifications might well be made to the illustrated embodiments without departing from the spirit and scope of the invention as set forth in the claims.

What is claimed is:

1. A doorjamb assembly comprising:

an elongated frame member having an inside face, an outside face, an inside edge, and an outside edge;

a stop member mounted to and extending along the length of said frame member adjacent said outside edge thereof, said stop member having a leg that overlies a portion of said inside face of said frame member and extends to a raised edge disposed intermediate said inside and said outside edges of said frame member; and an extension secured to said inside face of said frame member extending from said stop member toward said inside edge of said frame member, said extension having an outside edge abutting said raised edge of said stop member and an inside edge that forms a raised stop extending along said frame member spaced from said inside edge thereof.

2. A doorjamb assembly as claimed in claim 1 and wherein said frame member is formed of wood.

3. A doorjamb assembly as claimed in claim 1 and wherein said stop member is formed of extruded plastic material having a relatively less dense blown plastic core and a relatively more dense plastic skin.

4. A doorjamb assembly as claimed in claim 3 and wherein said extension is formed of extruded plastic material having a relatively less dense blown plastic core and a relatively more dense plastic skin.

5. A doorjamb assembly as claimed in claim 1 and further comprising a decorative brickmold extending along an outside edge of said stop member.

6. A doorjamb assembly as claimed in claim 5 and wherein said decorative brickmold is secured to said stop member.

7. A doorjamb assembly as claimed in claim 5 and wherein said decorative brickmold and said stop member are formed as a unitary structure.

8. A doorjamb assembly as claimed in claim 7 and wherein said brickmold and stop member are formed of extruded plastic having a relatively less dense blown plastic core and a relatively more dense plastic skin.

9. A doorjamb assembly comprising an elongated wooden frame member having an inside face, an outside face, an inside edge, and an outside edge, an elongated stop member mounted to said frame member extending generally along said outside edge thereof, said stop member including a leg that overlies a portion of said inside face of said frame member and forms a raised edge relative to said inside face of said frame member, said raised edge being intermediate said inside and outside edges, and an elongated extension mounted on said inside face of said frame member abutting said raised edge of said stop member and extending therefrom toward said inside edge of said frame member to an edge defining a raised stop extending along the length of said inside face of said frame member spaced from said inside edge thereof.

10. A doorjamb assembly as claimed in claim 9 and wherein said stop member is formed of extruded plastic with a relatively less dense plastic core and a relatively more dense plastic skin.

11. A doorjamb assembly as claimed in claim 10 and wherein said extension is formed of extruded plastic with a relatively less dense plastic core and a relatively more dense plastic skin.

12. A doorjamb assembly as claimed in claim 9 and further comprising a groove formed in said raised edge of said stop member adjacent said inside face of said frame member, said extension being formed with a locking tab sized to extend into said groove for holding said extension firmly against said inside face of said frame member.

13. A doorjamb assembly as claimed in claim 12 and wherein said stop member and said extension are each formed of extruded plastic and wherein each has a relatively less dense plastic core and a relatively more dense outer skin.

14. A doorjamb assembly as claimed in claim 13 and further comprising a groove formed in said raised stop adjacent said inside face of said frame member for receiving and holding a length of weather stripping for sealing against a door closed against said raised stop.

15. A doorjamb assembly as claimed in claim 14 and wherein said stop member at least partially covers said outside edge of said frame member and extends therefrom to an exposed edge portion of said stop member, said assembly further comprising a decorative brickmold on said stop member extending along said exposed edge portion thereof.

16. A doorjamb assembly as claimed in claim 15 and wherein said decorative brickmold is attached to said stop member.

17. A door jamb assembly as claimed in claim 15 and wherein said decorative brickmold and said stop member are extruded together as a unitary structure, said decorative brickmold being formed of extruded plastic and having a relatively less dense plastic core and a relatively more dense plastic skin.

18. A doorjamb comprising a wooden frame member having inside and outside edges and a face, a plastic stop member on said frame member, said stop member forming a raised edge located intermediate said inside and outside edges, and an extension on said frame member abutting said raised edge of said stop member and extending therefrom toward said inside edge of said frame member to an edge forming a raised stop relative to said frame member.

19. A doorjamb assembly as claimed in claim 18 and wherein said stop member and said extension are formed of extruded plastic and wherein each has a relatively less dense plastic core covered by a relatively more dense plastic skin.

* * * * *